US009376825B2

(12) United States Patent
Liao

(10) Patent No.: US 9,376,825 B2
(45) Date of Patent: Jun. 28, 2016

(54) MULTIFUNCTIONAL FILLER TOOL

(71) Applicant: Eric Liao, Taichung (TW)

(72) Inventor: Eric Liao, Taichung (TW)

( * ) Notice: Subject to any disclaimer, the term of this patent is extended or adjusted under 35 U.S.C. 154(b) by 0 days.

(21) Appl. No.: 14/810,176

(22) Filed: Jul. 27, 2015

(65) Prior Publication Data

US 2015/0330091 A1 Nov. 19, 2015

Related U.S. Application Data

(63) Continuation-in-part of application No. 13/778,792, filed on Feb. 27, 2013.

(51) Int. Cl.
*E04F 21/165* (2006.01)

(52) U.S. Cl.
CPC ..... *E04F 21/165* (2013.01); *E04F 21/1652* (2013.01); *E04F 21/1655* (2013.01)

(58) Field of Classification Search
CPC .. E04F 21/165; E04F 21/1652; E04F 21/1655
See application file for complete search history.

(56) References Cited

U.S. PATENT DOCUMENTS 2,336,284 A * 12/1943 Jennings ..... B26B 5/006 30/333
3,250,000 A * 5/1966 Schumann ..... A47L 13/08 15/236.05
4,783,867 A * 11/1988 Tsao ..... B26B 11/005 30/123
D332,901 S * 2/1993 Campbell ..... D8/45
5,513,405 A * 5/1996 Bradbury, Jr. ..... B26B 5/00 30/123
D420,882 S * 2/2000 Majolo ..... D32/46
6,035,536 A * 3/2000 Dewberry ..... E04F 21/0084 15/235.7
6,219,878 B1 * 4/2001 Dewberry ..... E04F 21/165 15/235.7
6,578,229 B1 * 6/2003 Dziallas ..... E04F 21/32 15/235.3
D480,288 S * 10/2003 DeLillo ..... D8/98
D605,911 S * 12/2009 Lian ..... D8/14
7,694,422 B2 * 4/2010 Vaes ..... B25F 1/00 30/162
D634,600 S * 3/2011 Gringer ..... D8/14
7,950,099 B1 * 5/2011 Hanson ..... E04F 21/165 15/105
8,307,490 B2 * 11/2012 Gringer ..... E04F 21/165 15/105
D687,201 S * 7/2013 Liao ..... D32/46
2006/0200932 A1 * 9/2006 Byrnes ..... A47L 1/16 15/236.06
2008/0034525 A1 * 2/2008 Panfili ..... B44C 7/027 15/236.01
2008/0209657 A1 * 9/2008 Hoffmann ..... E04F 21/0084 15/236.01
2010/0162509 A1 * 7/2010 Liao ..... E04F 21/165 15/235.7
2010/0162573 A1 * 7/2010 Liao ..... E04F 21/165 30/169
2011/0203064 A1 * 8/2011 Gringer ..... E04F 21/165 151/105.5
2014/0212200 A1 * 7/2014 Liao ..... B05C 17/00516 401/266

* cited by examiner

*Primary Examiner* — Joseph J Hail
*Assistant Examiner* — Marc Carlson
(74) *Attorney, Agent, or Firm* — Wang Law Firm, Inc.

(57) ABSTRACT

A multifunctional filler tool is a combination of three different tools, the trowel covers and slides along the scraper between the idle and active positions, namely, the trowel and the scraper do not increase the width of the entire multifunctional filler tool so as to limit the size of the multifunctional filler tool. When in the active position, the trowel fully covers the scraper, while the scraper does not interfere with the operation of the trowel. When in the idle position, the trowel moves away from the scraper while still keeping abutting against the scraper, namely, the trowel won't protrude in the upward direction to stick out of the scraper; therefore, the trowel does not interfere with the gripping of the handle.

2 Claims, 15 Drawing Sheets

MULTIFUNCTIONAL FILLER TOOL

This application is a continuation in part of U.S. patent application Ser. No. 13/778,792, which claims the benefit of the earlier filing date of Feb. 27, 2013.

BACKGROUND OF THE INVENTION

1. Field of the Invention

The present invention relates to a hand tool, and more particularly to a multifunctional filler tool.

2. Related Prior Art

Filler is usually used to fill up cracks or corners between two objects and includes, but not limited to, concrete and silicone. The work of filling cracks with fillers involves scraping off old filler or impurities, filling the filler into the cracks, and decoration.

Therefore, the work of applying filler requires the use of a scraper for scrapping off the old filler and other tools for applying the filler and finishing the surface. Furthermore, the use of different angled and shaped scrapers or shovels is also required, when it comes corners with different angles and shapes, since each tool is used for unique purpose. However, carrying too many different tools is troublesome.

As shown in FIGS. 1-3, U.S. Pat. No. 5,513,405 a multipurpose tool 10 includes an upper portion 11 and a lower portion 12 which are held together by two screws 13 to clamp a metal hook-shaped blade 14 and a metal straight blade 15 therebetween. The hook-shaped blade 14 is linearly movably disposed at one end of the multipurpose tool 10, and able to be extended out of the end of the multipurpose tool 10 or retracted between the upper portion 11 and the lower portion 12. The straight blade 15 is pivotally disposed between the upper and lower portions 11, 12, so that the straight blade 15 can be rotated out of the end of the multipurpose tool 10 or back into the space between the upper and lower portions 11, 12. At another end of the multipurpose tool 10 is integrally formed a scraper 16 which is integral with the upper portion 11 and includes a flat and straight scraping surface 161. Between the two ends of the multipurpose tool 10 is a handle portion 17.

It is to be noted that the hook-shaped blade 14 is used to remove bottle caps, the straight blade 15 is used for cutting, and the scraper 16 is used for scraping, therefore, the multipurpose tool 10 is mainly for use in recycling activities. When it comes to flattening the filler filled in the corner or crack, the scraper 16 of the multipurpose tool 10 only has a straight and flat scraping surface 161 which is incapable of performing scraping in a corner. Besides, the corner of a building is normally provided with flat edges rather than rather arc-shaped, the hook-shaped blade 14 is arc-shaped and therefore unable to perform scraping of filler on the straight and flat edges of the corner, while the straight blade 15 is not hard enough to scrape the filler. Therefore, the multipurpose tool 10 is not suitable for use in applying filler.

FIG. 4 shows another multifunction caulk tool 20 disclosed in U.S Patent Application No. 2011/0203064, the caulk tool 20 is provided with a handle 21, and both ends of the handle are bent downward to form two tool bits 22, 23. The first bit 22 is a triangle structure, and the second bit is a metal hollow structure with a sharp end formed at an angle of 65-85 degrees, which makes the second bit suitable for use in a corner of a building. The sharp end of the second bit 23 extends to form a work edge 231. At the same end of the multifunction caulk tool 20 where the second bit 23 is located is further provided a third bit 24 which is a plate protruding upward.

Since the third bit 24 is located adjacent to the second bit 23 and protrudes upward out of the handle 21, the user has to avoid the position of the third bit 24 when gripping the handle 21, namely, the user is unable to grip the portion of the handle 21 where the third bit 24 is formed.

The present invention has arisen to mitigate and/or obviate the afore-described disadvantages.

SUMMARY

The present invention is aimed providing a multifunctional filler tool which is easy to grip and free of the disadvantages of the conventional multifunctional filler tools.

A multifunctional filler tool in accordance with the present invention includes: a handle, a shovel, a sliding element, a slide assembly, and a trowel.

The handle is an arc-shaped structure with a first end and a second end, and a top surface and a bottom surface. A direction from the bottom surface to the top surface is defined as an upward direction, and a direction opposite to the upward direction is defined as a downward direction. The handle further includes two lateral surfaces extending from the top surface, at the first end is integrally formed a scraper with a scraping edge. The scraping edge extends linearly and is used to make a flat surface on filler, the handle is provided with a slot which is located between the first and second ends, and penetrates the top and bottom surfaces. The slot extends along an axis of the handle and is provided with a first positioning notch located adjacent to the first end and a second positioning notch located adjacent to the second end, and at each of the two lateral surfaces is formed a guiding groove.

The shovel is made by folding a metal at an angle of 90 degrees and connected to the second end of the handle.

The sliding element is a cap-shaped structure with a chamber, one end of the sliding element is an open end, and another end of the sliding element is formed with an insert which is a triangle-shaped plate. The insert is provided with two ear portions, an inner surface of the chamber is defined as an inner surface of the sliding element, on the inner surface of the sliding element is provided two opposite guiding portions and two stems, the handle is inserted in the chamber in such a manner that the sliding element covers the top surface and the two lateral surfaces of the handle, the two stems are inserted in the slot, and the guiding portions of the sliding element are slidably received in the guiding grooves of the handle.

The sliding assembly includes a stop member and a fastener, the stop member is unable to pass through the slot, the two stems of the sliding element are inserted through the slot, and then stop member is fixed to the stems by the two fastener, so that the sliding member is secured to the handle and movable along the guiding grooves, and the stop member is provided with a boss which is selectively positioned in the first or second positioning notch.

The trowel is a hollow triangle structure with a tip and a pocket, the pocket is larger than the insert, so that the insert is capable of is inserted in the pocket, the trowel further includes two apertures which are in communication with the pocket and aligned with the two ear portions, the trowel is removably sleeved onto the insert, and the two ear portions is engaged in the two apertures, the trowel is driven by the sliding element to move between an idle position and an active position while keeping abutting against the scraper. When in the active position, the trowel is located the upward direction and covers the scraper, and the boss of the stop member is moved into the first positioning notch. When in the idle portion, the trowel slides away from the scraping edge while keeping abutting against the scraper, and the stop member is moved to a position where the boss is engaged in the second positioning notch, the trowel is able to make an arc-shaped surface on filler corresponding to a curvature of the tip and made of plastic material.

The present invention is a combination of three tools with the scraper and the shovel disposed at both ends of the handle, and the trowel connected to the handle via a sliding element. The sliding element can enable to the trowel to move with respect to while keeping abutting against the scraper, so as to limit the height or width of the multifunctional filler tool of the present invention. Besides, the trowel won't protrude in the upward direction to stick out of the scraper, thus preventing interference with the gripping of the handle.

DETAILED DESCRIPTION

Figure 1:
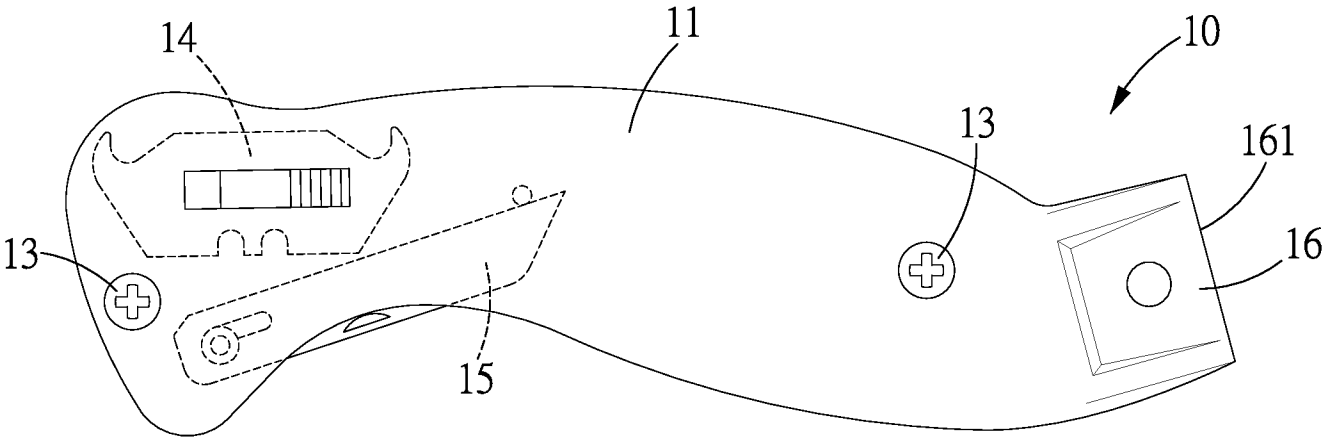
FIG.1 PRIOR ART
FIG. 1 is a perspective view of the conventional multifunctional filler tool.
Figure 2:
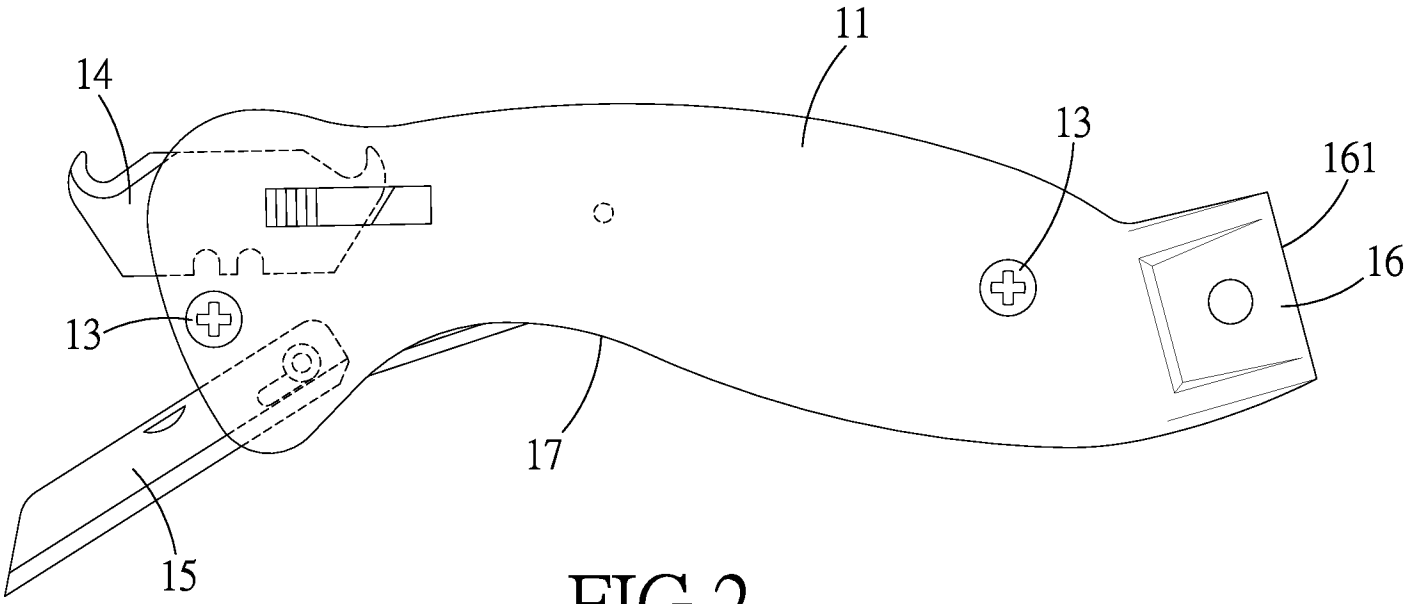
FIG.2 PRIOR ART
FIG. 2 is another perspective view of the conventional multifunctional filler tool.
Figure 3:
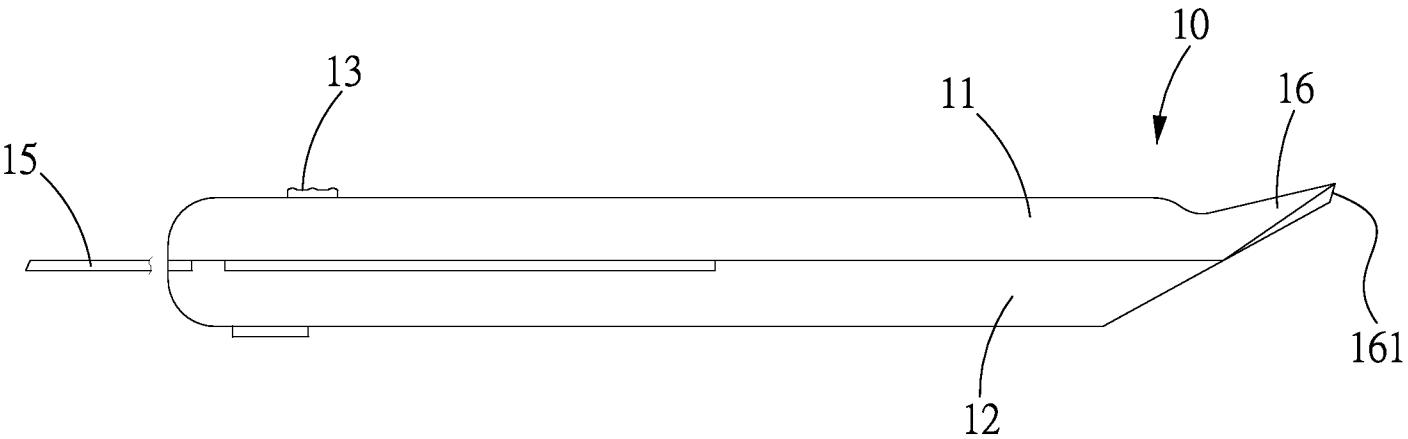
FIG.3 PRIOR ART
FIG. 3 is a side view of the conventional multifunctional filler too.
Figure 4:
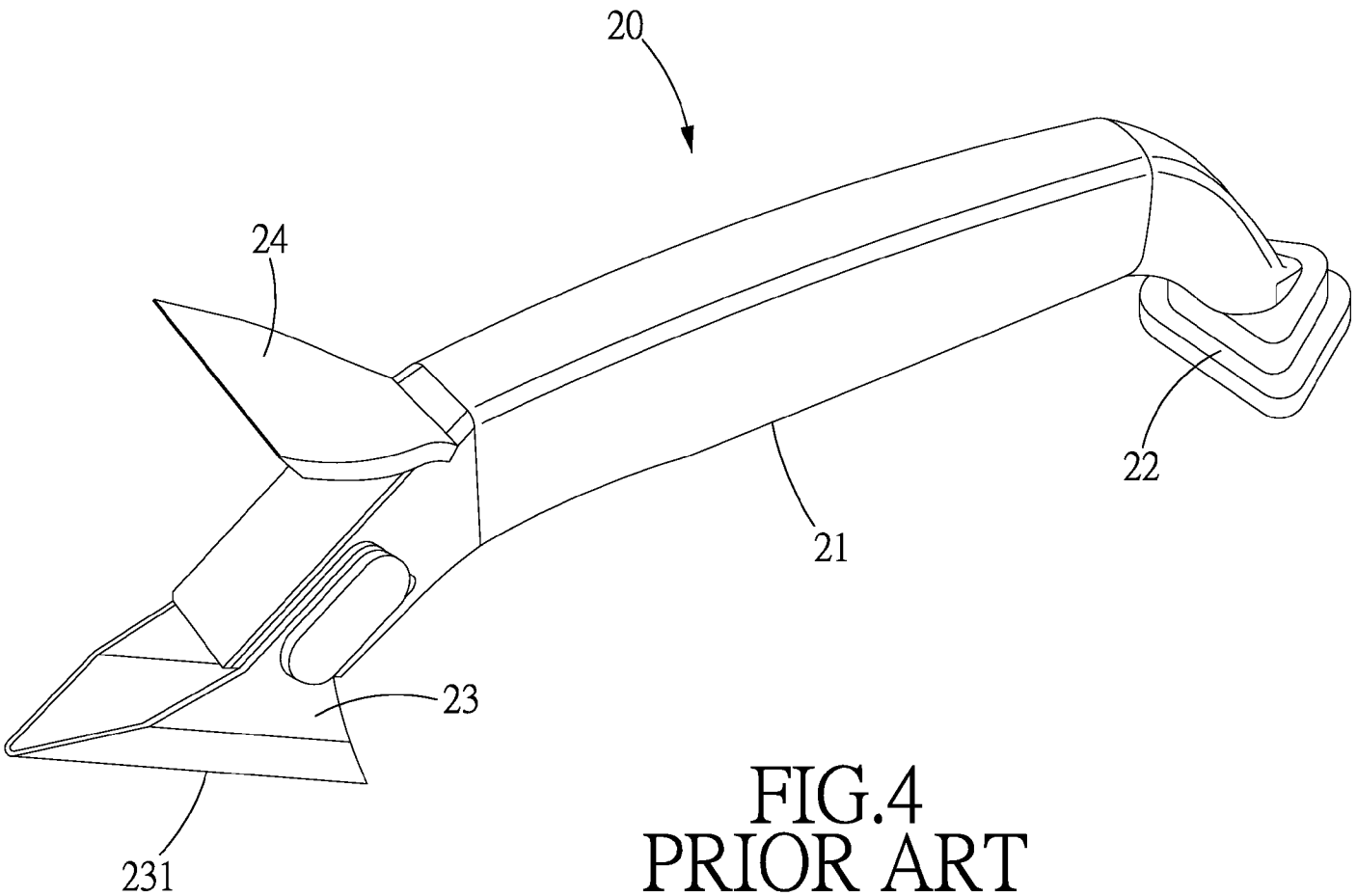
FIG.4 PRIOR ART
FIG. 4 is a perspective view of another conventional multifunctional filler tool.

The present invention will be clearer from the following description when viewed together with the accompanying drawings, which show, for purpose of illustrations only, the preferred embodiment in accordance with the present invention.

Referring to FIGS. 5-15, a multifunctional filler tool in accordance with the present invention is provided with a handle 30, a shovel 40, a sliding element 50, a slide assembly 60, and a trowel 70.

The handle 30 is an arc-shaped structure with a first end 31 and a second end 32, and a top surface 32 and a bottom surface 34. A direction from the bottom surface 34 to the top surface 33 is defined as an upward direction U, and a direction opposite to the upward direction U is defined as a downward direction D. The handle 30 further includes two lateral surfaces 35 extending from the top surface 33. At the first end 31 is integrally formed with a scraper 36 which has a scraping edge 361. The scraping edge 361 extends linearly and is used to make a flat surface on filler. The handle 30 is provided with a slot 37 which is located between the first and second ends 31, 32 and penetrates the top and bottom surfaces 33, 34. The slot 37 extends along the axis of the handle 30 and is provided with a first positioning notch 371 located adjacent to the first end 31 and a second positioning notch 372 located adjacent to the second end 32. At each of the two lateral surfaces 35 is formed with a guiding groove 351.

The shovel 40 is made of metal and includes two opposite connecting portions 41 and an angled portion 42 between the two connecting portions 41. The angled portion 42 has an angle of 90 degrees. The shovel 40 is connected to the second end 32 of the handle 30 in such a manner that the two connecting portions 41 are abutted against and fixed to two lateral surfaces of the second end 32 of the handle 30 by a plurality of rivets. The shovel 40 is used to remove filler from a slit or a corner between two objects.

The sliding element 50 is a cap-shaped structure with a chamber 51, one end of the sliding element 50 is an open end, and another end of the sliding element 50 is formed with an insert 52 which is a triangle-shaped plate. The insert 52 is provided with two ear portions 521. An inner surface of the chamber 51 is defined as an inner surface of the sliding element 50; on the inner surface of the sliding element 50 are provided two opposite guiding portions 53 and two stems 54. The handle 30 is inserted in the chamber 51 in such a manner that the sliding element 50 covers the top surface 33 and the two lateral surfaces 35 of the handle 30, the two stems 54 are inserted in the slot 37, and the guiding portions 53 of the sliding element 50 are slidably received in the guiding grooves 351 of the handle 30. The stems 54 are not limited to being two in number, and a single stem 54 also has the same effect as the abovementioned embodiment.

The sliding assembly 60 includes a stop member 61 and two fasteners 62. The stop member 61 is unable to pass through the slot 37 because of a shape thereof, the two stems 54 of the sliding element 50 are inserted through the slot 37, and then stop member 61 is fixed to the stems 54 by the two fasteners 62, so that the sliding member 50 is secured to the handle 30 and movable along the guiding grooves 351. The stop member 61 is provided with two bosses 611 which can selectively engage the first or second positioning notches 371, 372. The fasteners 62 are not limited to being two in number, and a single fastener 62 can be used to cooperate with a single stem 54 to achieve the same effect as the previous embodiment, and of course, the stop member 61 can also be provided with only a single boss 611.

The trowel 70 is a hollow triangle structure with a tip 71 and a pocket 72. The pocket 72 is larger than the insert 52, so that the insert 52 can be inserted in the pocket 72. The trowel 70 further includes two apertures 73 which are in communication with the pocket 72 and aligned with the two ear portions 521. The trowel 70 is removably sleeved onto the insert 52, and the two ear portions 521 are engaged in the two apertures 73. The trowel 70 is driven by the sliding element 50 to move between an idle position and an active position while keeping abutting against the scraper 36. When in the active position, the trowel 70 is located on the upward direction and covers the scraper 36, and the bosses 611 of the stop member 61 are moved into the first positioning notch 371. When in the idle portion, the trowel 70 slides away from the scraping edge 361 while keeping abutting against the scraper 36, and the stop member 61 is moved to a position where the bosses 611 engage the second positioning notch 372. The trowel 70 is able to make an arc-shaped surface on filler corresponding to the radius of curvature of the tip 71 and made of plastic material. The trowel 70 can be adjusted to have tips 71 of different curvatures.

Referring then to FIGS. 7-15, the user can optionally use the scraper 36 and the shovel 40 at both ends of the handle 30 or use the trowel 70 on the sliding element 50. The trowel 70 can be adjusted to the idle position or the active position by switching the sliding element 50. The sliding element 50 and the stop member 61 move synchronously, when the stop member 61 moves to a position where the bosses 611 engage the first positioning notch 371, the sliding element 50 pushes the trowel 70 to the active position where the trowel 70 located in the upward direction to fully cover the scraper 36 (as shown in FIGS. 12-15). When the stop member 61 moves to a position where the bosses 611 engage the second positioning notch 372, the sliding element 50 pushes the trowel 70 to the idle position (as shown in FIGS. 7-10), during the course, the trowel 70 slides away from the scraping edge 361 while keeping abutting against the scraper 36.

It is to be noted that the trowel 70 of the present invention always keeps abutting against the scraper 36 no matter in the idle or the active position. Namely, the trowel 70 won't affect the handling of the handle 30, which allows the user to stably grip the handle 30 no matter whichever the scraper 36 and the trowel 70 is being used. Hence, the tool of the preferred embodiment present invention can be used more conveniently.

Besides, when the trowel 70 is pushed by the sliding element 50 from the idle position to the active position, the guidance of the stems 54 and the slot 37, and the guidance of the guiding portions 53 and the guiding grooves 351 ensure a smooth movement of the sliding element 50. When the bosses 611 of the stop member 61 engage the first or second positioning notch 371, 372 of the handle 30, a retaining force will be created to retain the trowel 70 in the idle or the active position.

The three different functional elements (the scraper, the trowel and the shovel) are combined on the handle 30 without interfering with one another. Furthermore, the trowel 70 is slidably abutted against the scraper 36, nothing sticks out of the handle 30, so that the profile of the multifunctional filler tool is limited and facilitates the gripping of the handle 30 by the user.

The handle 30 is arc-shaped for facilitating gripping thereof by user, and the sliding element 50 and the stop member 61 are all arc-shaped to fit the curvature of the handle 30. In addition to gripping, the arc-shaped configuration also facilitates the retaining of the trowel 70 in the idle or active position. Particularly, in the active position shown in FIG. 14, the multifunctional filler tool is subjected to a force as indicated by the arrow A, and there is a counterforce as indicated by an arrow B, the arc-shaped configuration of the handle 30 facilitates the exerting of the force against the counterforce, i.e., the user firmly holds the trowel 70.

Figure 5:
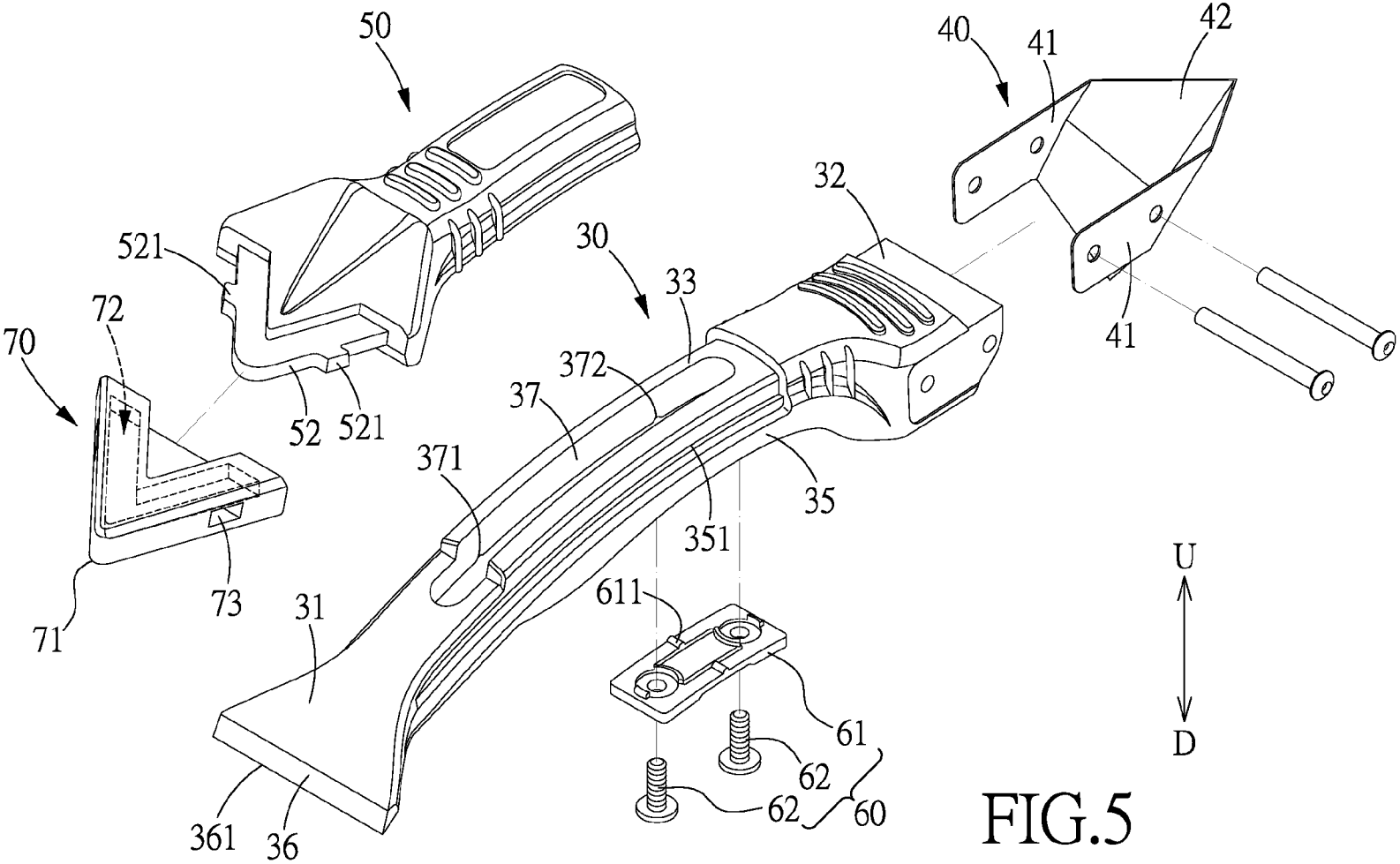
FIG. 5 is an exploded front view of a preferred embodiment of the present invention.
Figure 6:
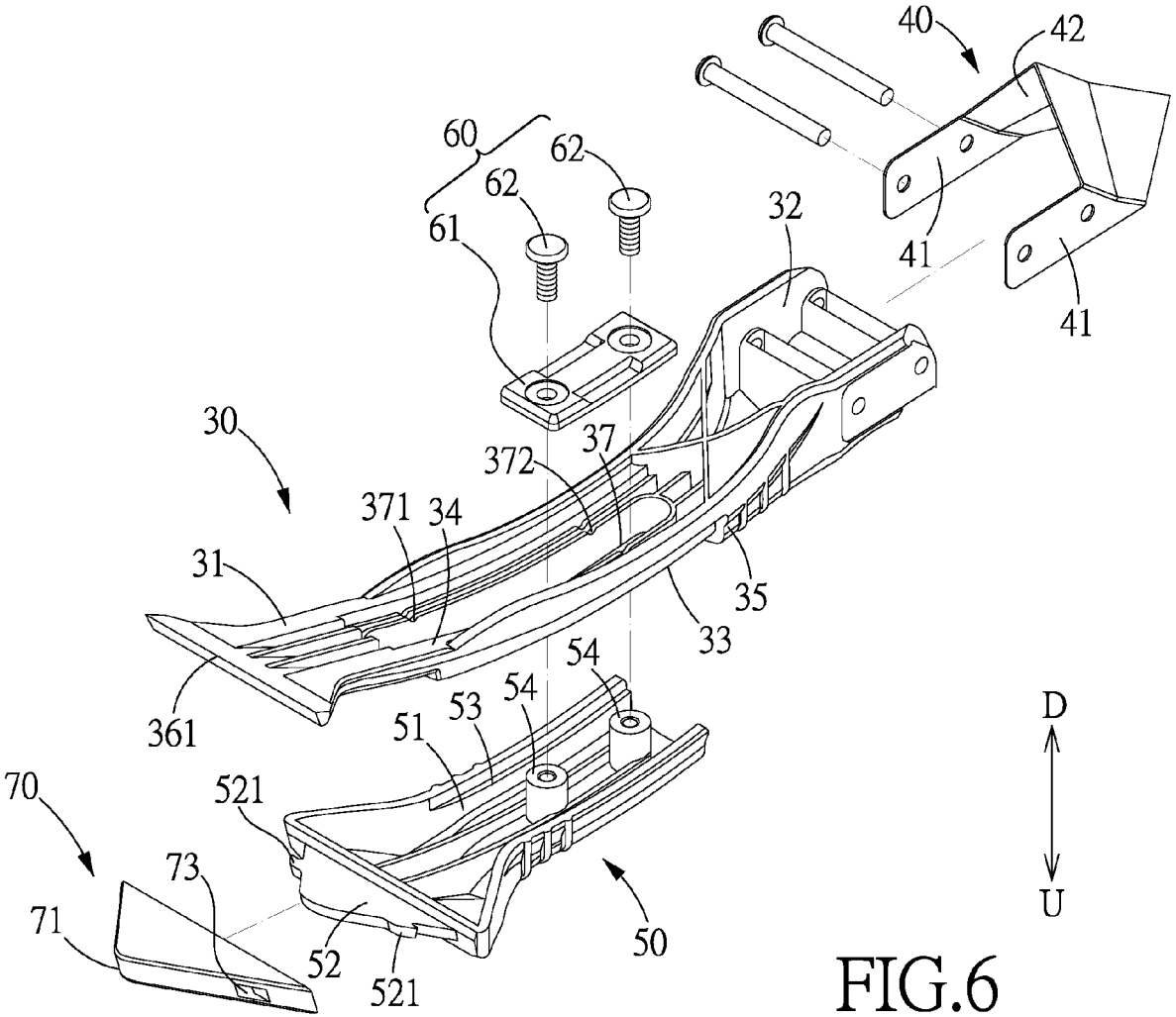
FIG. 6 is an exploded rear view of the preferred embodiment of the present invention.
Figure 7:
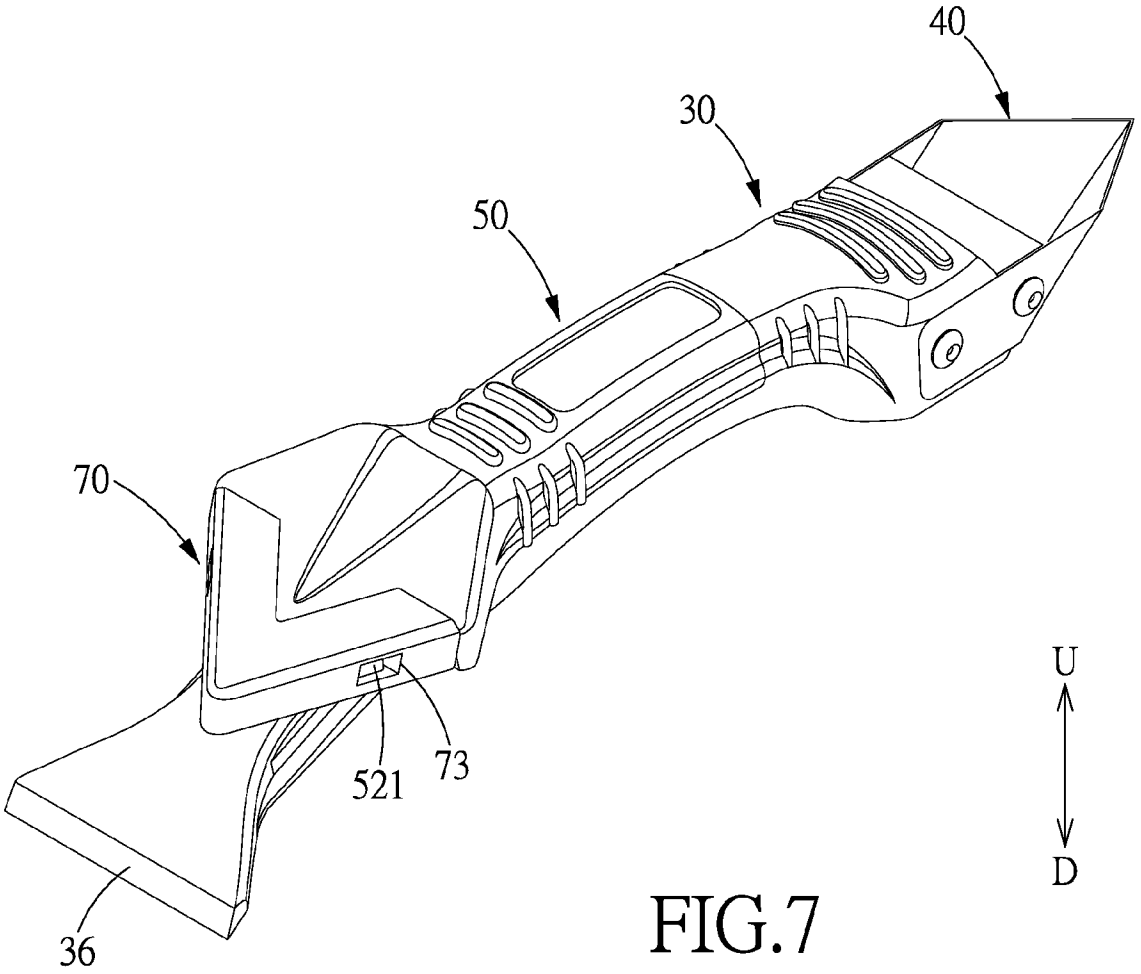
FIG. 7 is a front assembly view of the preferred embodiment of the present invention.
Figure 8:
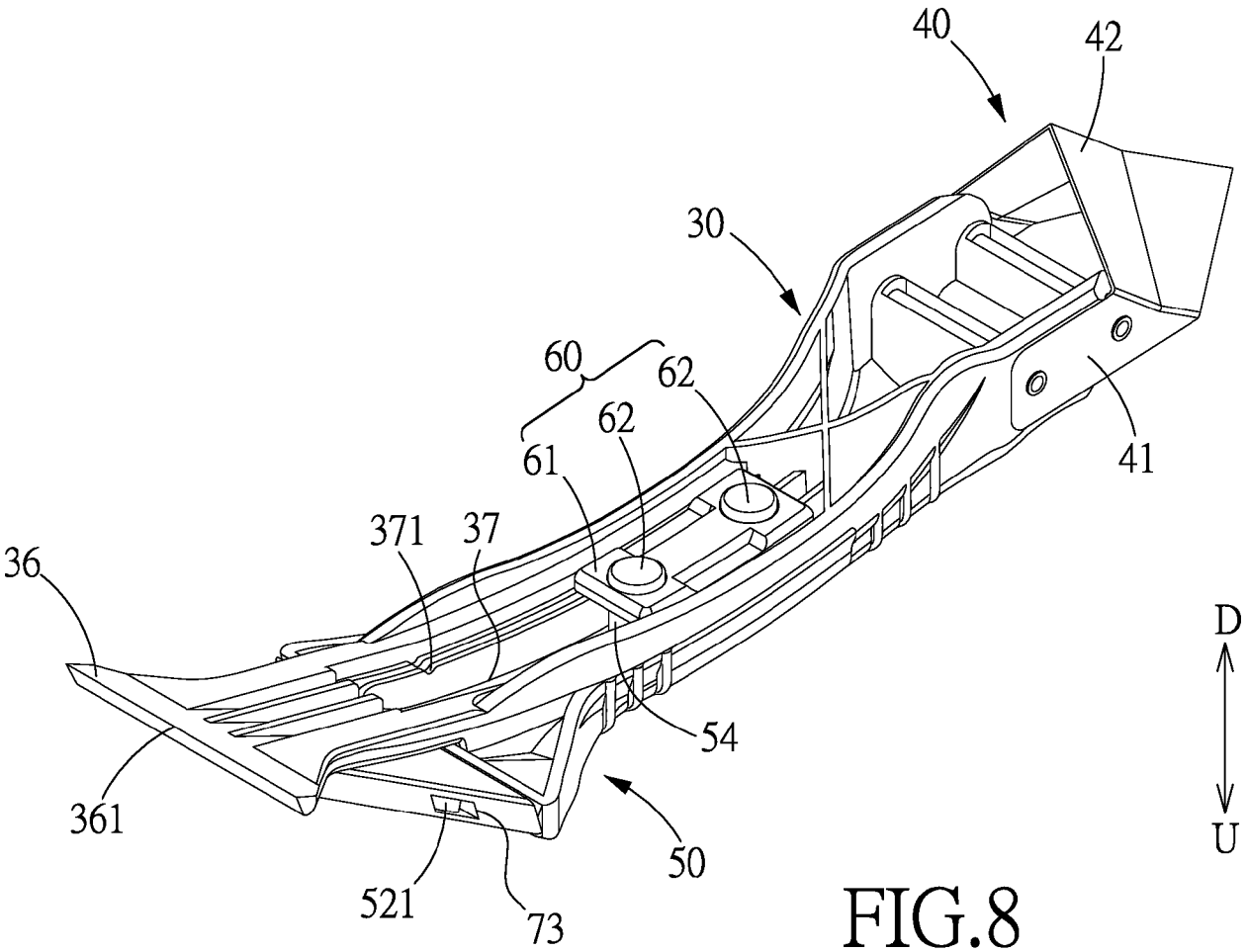
FIG. 8 is a rear assembly view of the preferred embodiment of the present invention.
Figure 9:
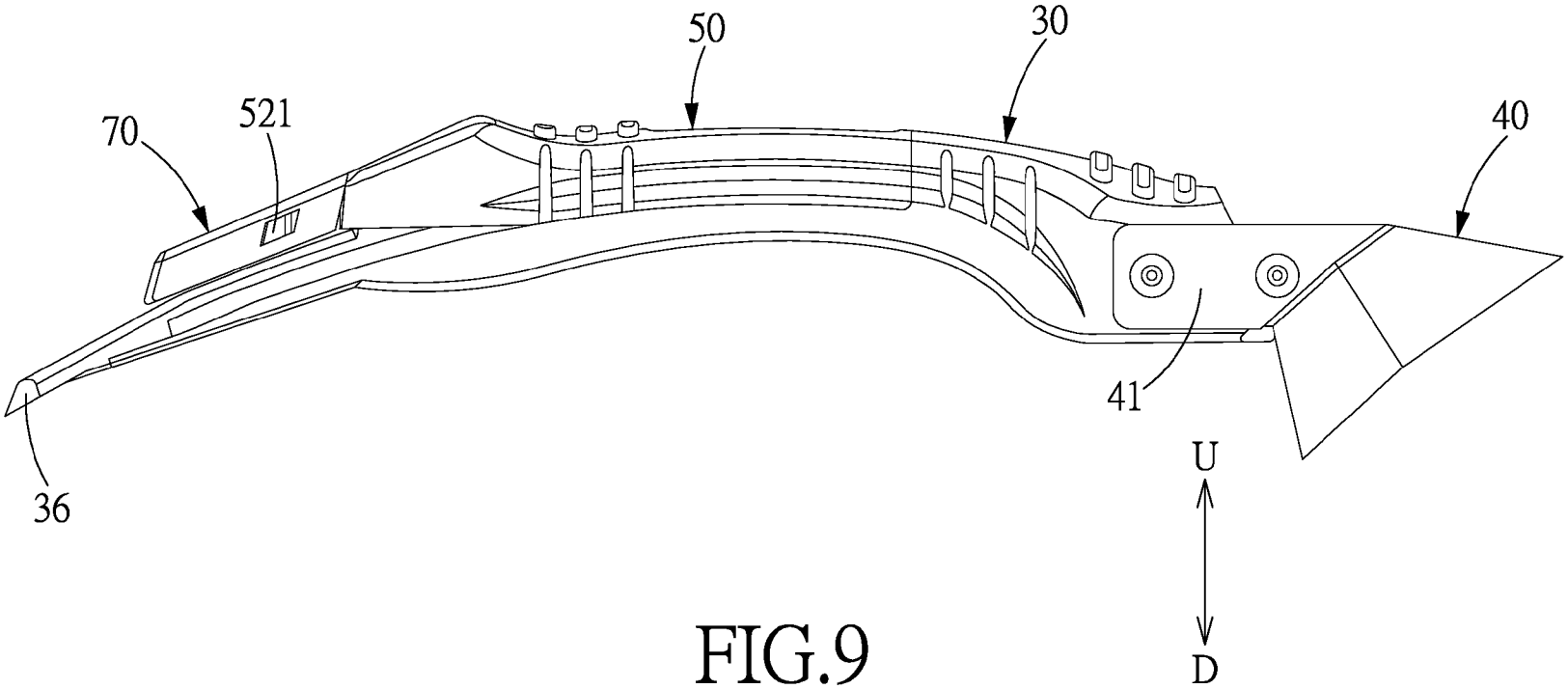
FIG. 9 is a side view of the preferred embodiment of the present invention, showing that the trowel is in the idle position.
Figure 10:
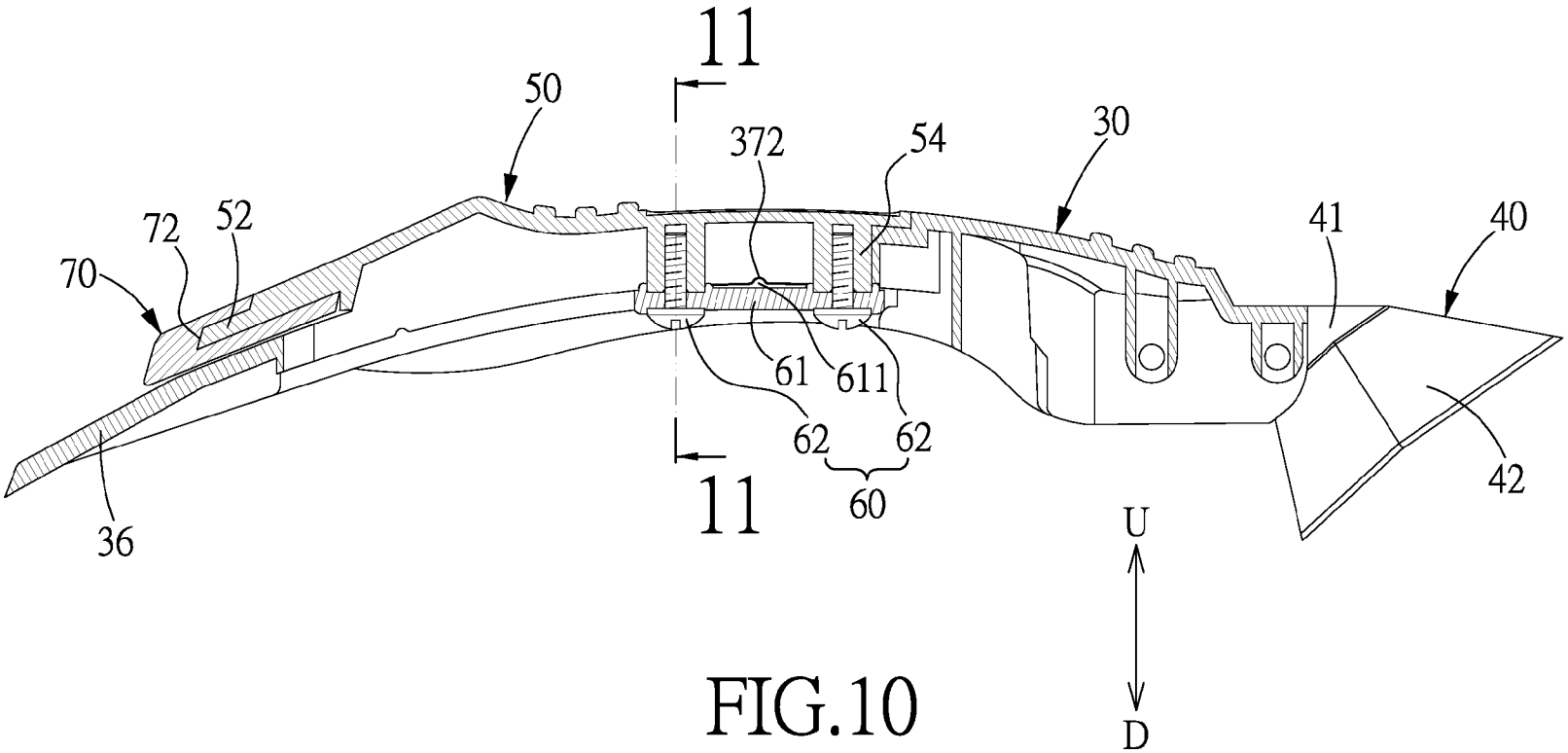
FIG. 10 is a cross sectional view taken along the line 10-10 of FIG. 7.
Figure 11:
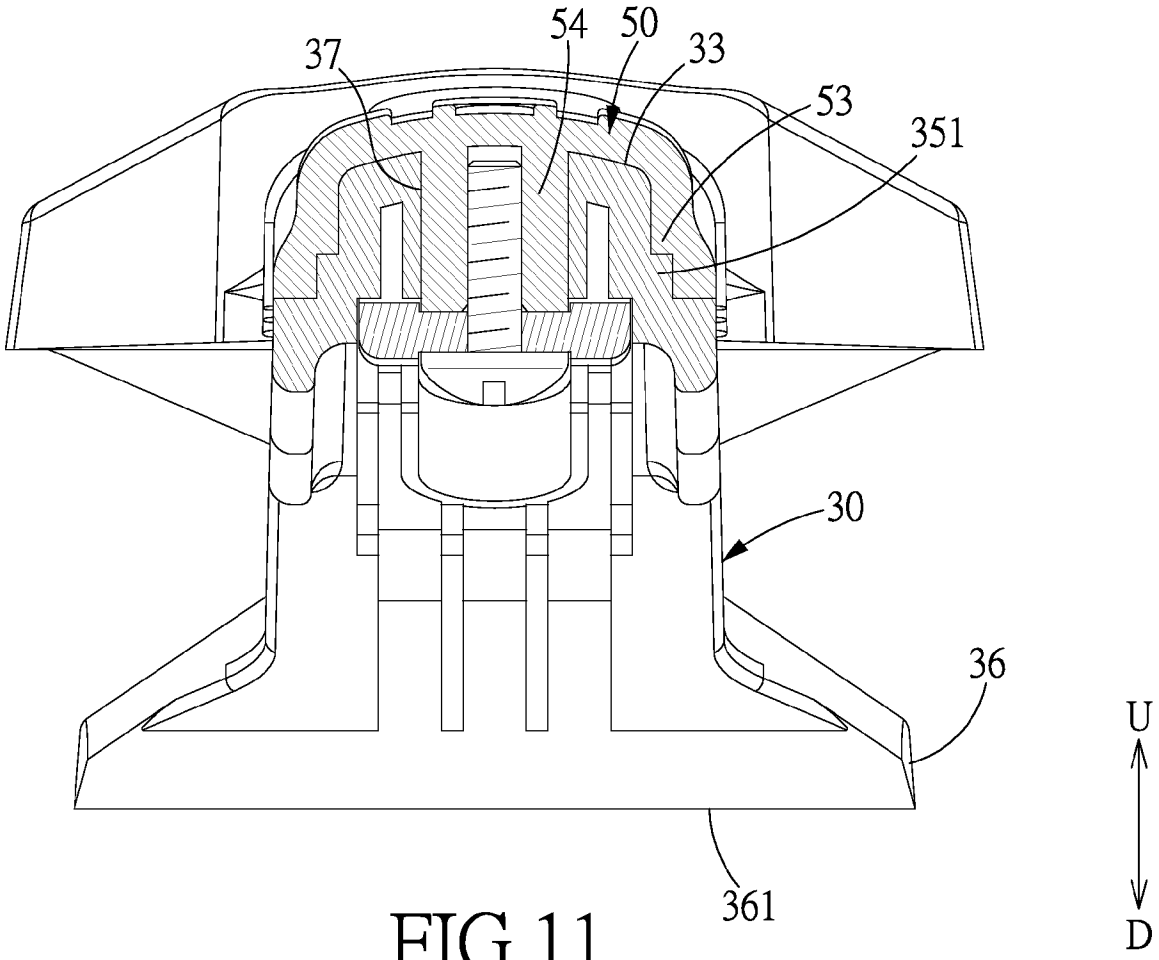
FIG. 11 is a cross sectional view taken along the line 11-11 of FIG. 10.
Figure 12:
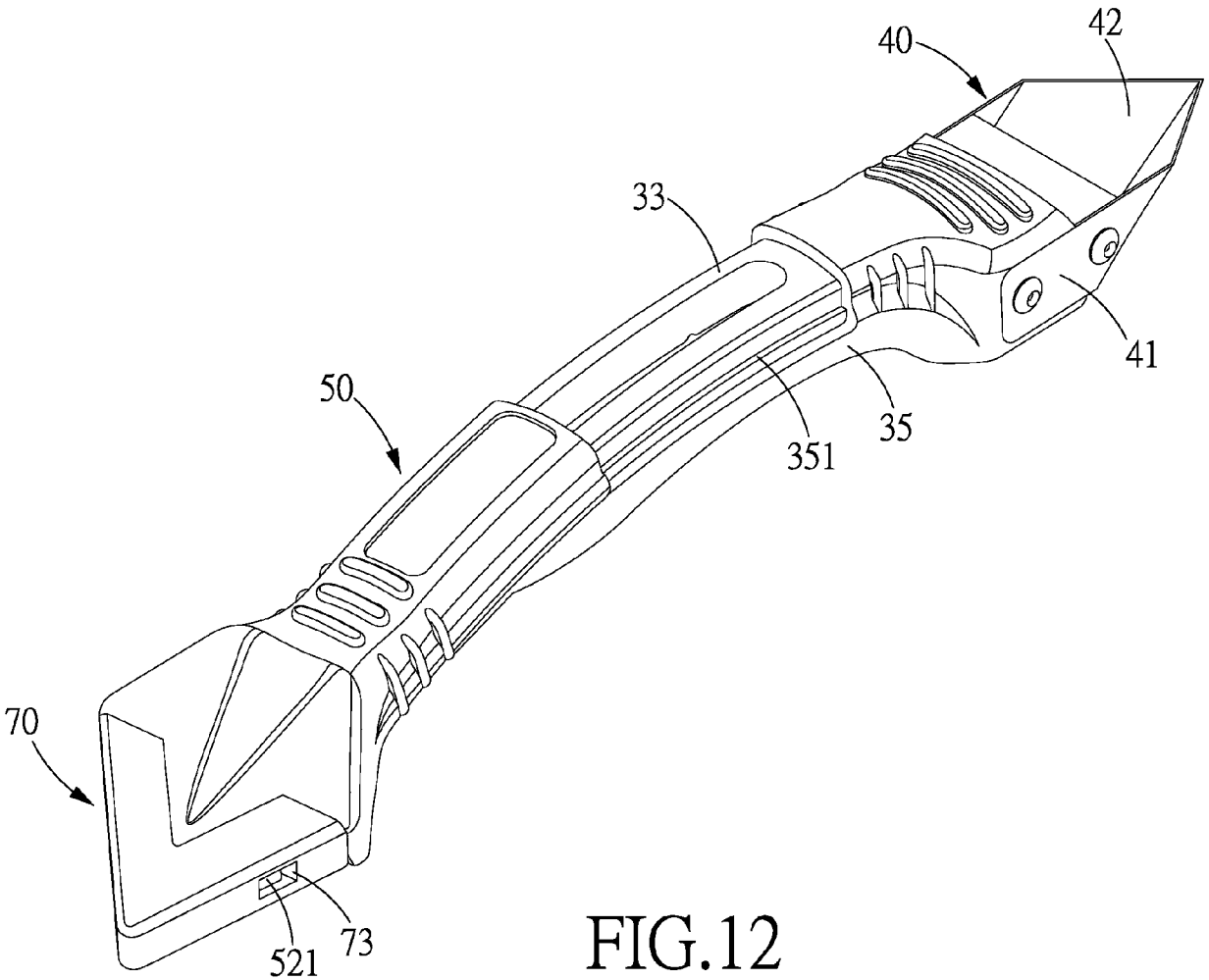
FIG. 12 is a front assembly view of the preferred embodiment of the present invention, showing that the trowel is in the active position.
Figure 13:
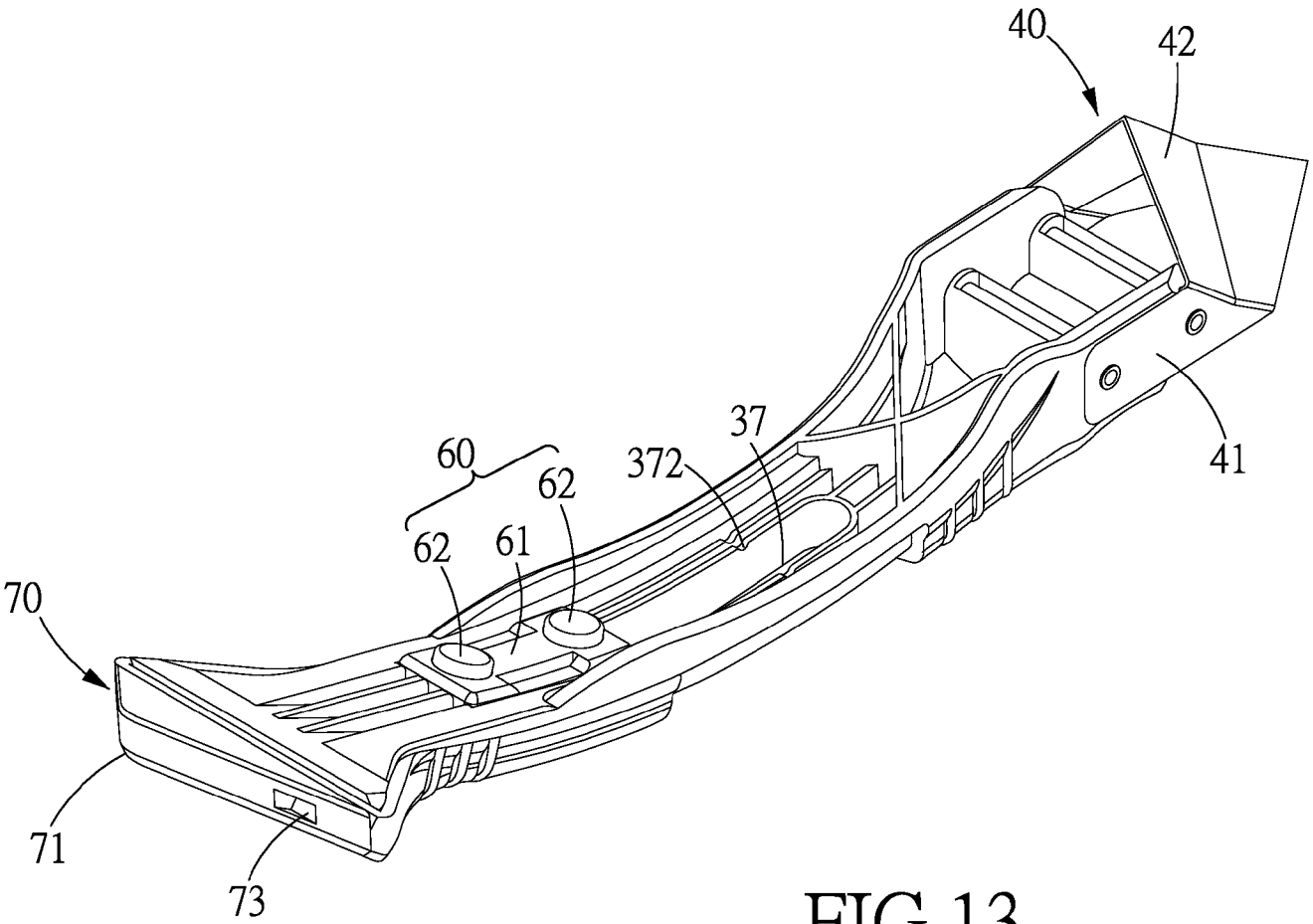
FIG. 13 is a rear assembly view of the preferred embodiment of the present invention, showing that the trowel is in the active position.
Figure 14:
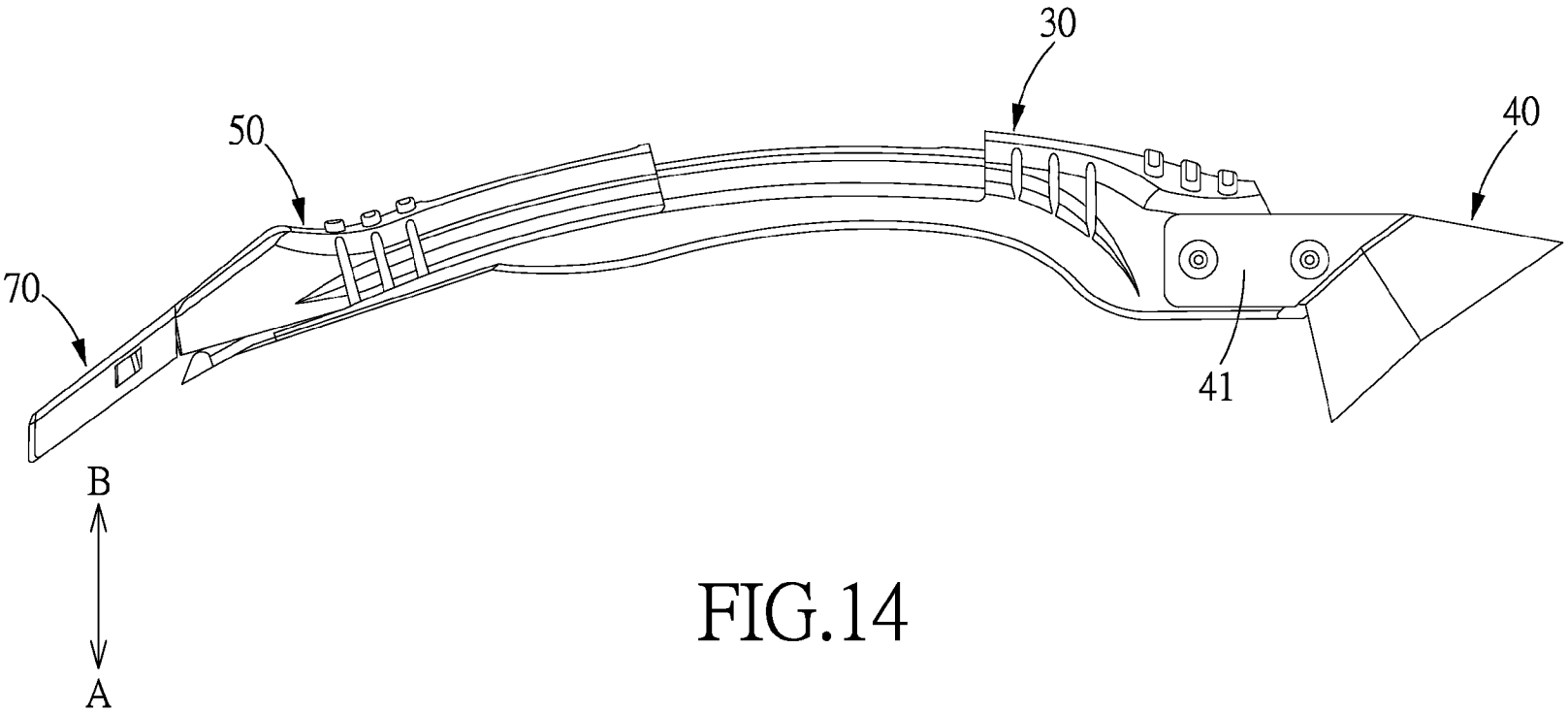
FIG. 14 is a side view of the preferred embodiment of the present invention, showing that the trowel is in the active position.
Figure 15:
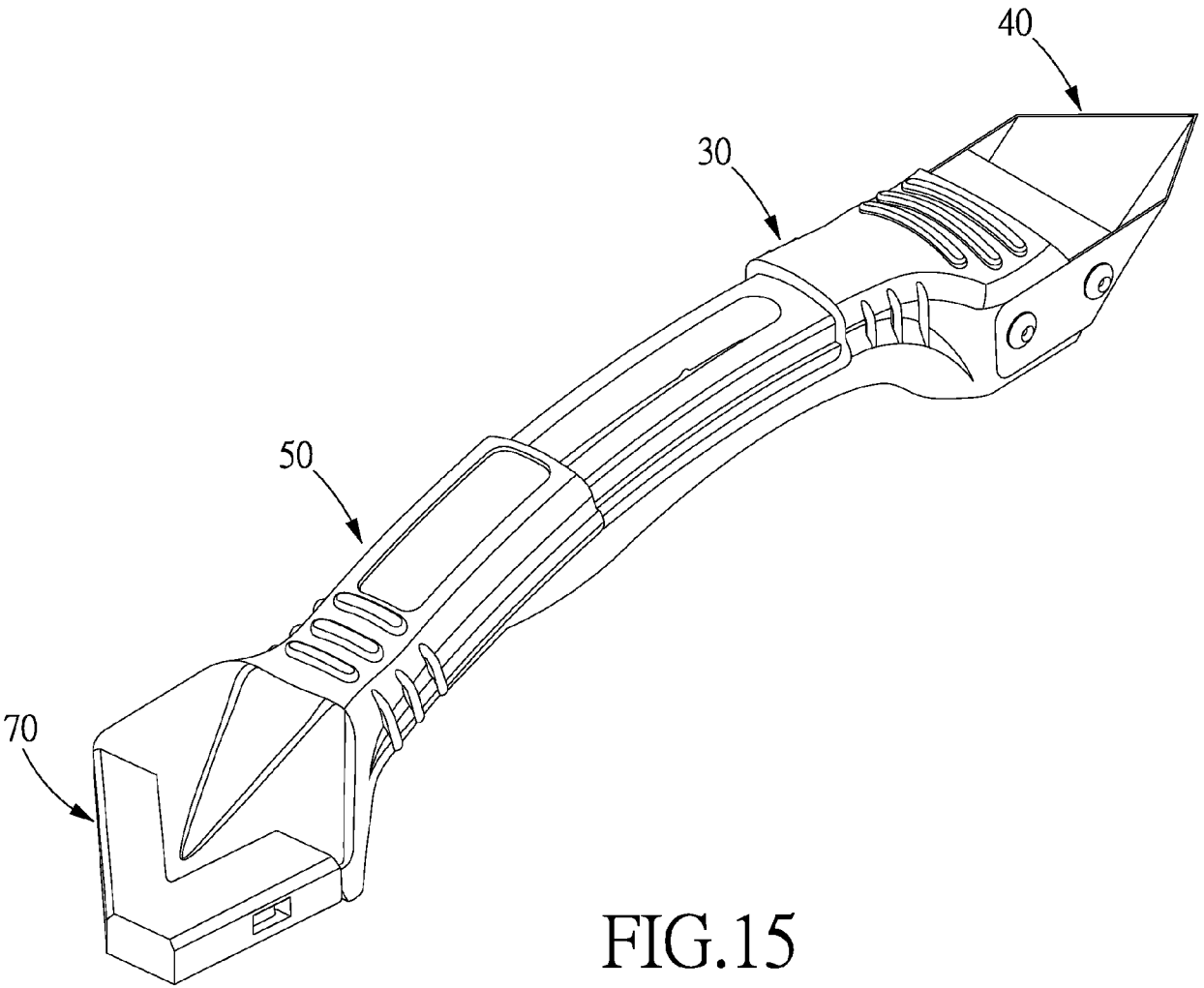
FIG. 15 is a perspective view of a preferred embodiment of another embodiment of the present invention.

Referring to FIGS. 5 and 6, the trowel 70 is detachably secured to the sliding element 50 and therefore can be replaced with different trowels 70 with different shaped tips 71, for example, as shown in FIG. 15, a trowel 70 with a different tip 71 than the previous embodiment is secured to the sliding element 50.

In summary, the multifunctional filler tool of the present invention is a combination of three different tools, the trowel 70 covers and slides along the scraper 36 between the idle and active positions, namely, the trowel 70 and the scraper 36 do not increase the width of the entire multifunctional filler tool, so that the size of the multifunctional filler tool is limited. When in the active position, the trowel 70 can fully cover the scraper 36, while the scraper 36 does not interfere with the operation of the trowel 70. When in the idle position, the trowel 70 moves away from the scraper 36 to expose the scraping edge 361 while still keeping abutting against the scraper 36, namely, the trowel 70 won't protrude in the upward direction U to stick out of the scraper 30, therefore, the trowel 70 does not interfere with the gripping of the handle 30. Besides, the trowel 70 is made of silicon material, when it is in the active position, the trowel 70 can fully cover the scraper 36, protecting the scraper 36 from damage.

While we have shown and described various embodiments in accordance with the present invention, it is clear to those skilled in the art that further embodiments may be made without departing from the scope of the present invention.

What is claimed is:

1. A multifunctional filler tool, comprising:

a handle having an arc-shaped structure with a first end, a second end, a top surface, a bottom surface, and two lateral surfaces, wherein a direction from the bottom surface to the top surface is defined as an upward direction, a direction opposite to the upward direction is defined as a downward direction, and the lateral surfaces extend from opposite sides of the top surface; the handle further including a scraper integrally formed on the first end; the scraper having a scraping edge, and the scraping edge extending linearly to be used to make a flat surface on filler; the handle further being provided with a slot, a first positioning notch, and a second positioning notch, wherein the slot is between the first end and the second end, and penetrates the top surface and the bottom surface, and the first positioning notch and the second positioning notch are on a sidewall of the slot, where the first positioning notch is adjacent to the first end, and the second positioning notch is adjacent to the second end; and two guiding grooves being provided on the lateral surfaces;

a shovel connected to the second end of the handle, wherein the shovel is made of a metal, and has an angle of 90 degrees;

a sliding element having a cap-shaped structure with a chamber and an open end; the sliding member further including an insert, which is a triangle-shaped plate, on an end opposite to the opening end; the insert being provided with two ear portions; the sliding element having an inner surface facing the chamber, on which two opposite guiding portions and two stems are provided, wherein the handle is inserted in the chamber in such a manner that the sliding element covers the top surface and the two lateral surfaces of the handle, the stems are inserted in the slot, and the guiding portions of the sliding element are slidably received in the guiding grooves of the handle;

a sliding assembly including a stop member and a fastener, wherein the stop member is unable to pass through the slot because of a shape thereof, and fixed to the stems by the fastener, so that the sliding member is secured to the handle and movable along the guiding grooves; the stop member being provided with a boss which selectively engages the first positioning notch or the second positioning notch; and a trowel having a hollow triangle structure with a tip and a pocket, wherein the pocket is larger than the insert, so that the insert is capable of being inserted in the pocket; the trowel further including two apertures which are in communication with the pocket and aligned with the two ear portions; the trowel being removably sleeved onto the insert, and the two ear portions engaging the two apertures; the trowel being driven by the sliding element to move between an idle position and an active position while keeping abutting against the scraper, wherein when in the active position, the trowel is located on the upward direction and covers the scraper, and the boss of the stop member is moved into the first positioning notch; further wherein when in the idle portion, the trowel slides away from the scraping edge while keeping abutting against the scraper, and the stop member is moved to a position where the boss engages the second positioning notch, whereby the trowel is able to make an arc-shaped surface on filler corresponding to a curvature of the tip and made of plastic material.

2. The multifunctional filler tool as claimed in claim 1, wherein the shovel includes two opposite connecting portions and an angled portion between the two connecting portions, the angled portion has an angle of 90 degrees, the shovel is connected to the second end of the handle in such a manner that the two connecting portions are abutted against and fixed to two lateral surfaces of the second end of the handle by a plurality of rivets.

* * * * *